United States Patent [19]

Kückens

[11] 4,096,971

[45] Jun. 27, 1978

[54] METHOD OF AND APPARATUS FOR DISPENSING SELF-CONSERVING LIQUIDS

[75] Inventor: Alexander Kückens, Hamburg, Germany

[73] Assignee: Dagma GmbH & Co. Deutsche Automaten- und Getränke - Maschinen, Reinfeld, Holstein, Germany

[21] Appl. No.: 728,170

[22] Filed: Sep. 30, 1976

Related U.S. Application Data

[63] Continuation of Ser. No. 560,798, Mar. 21, 1975, abandoned, which is a continuation-in-part of Ser. No. 536,592, Dec. 26, 1974, abandoned.

[51] Int. Cl.[2] ..... B67D 5/56

[52] U.S. Cl. ..... 222/1; 222/70; 222/129.4; 222/145; 222/571

[58] Field of Search ..... 222/1, 70, 129.1, 129.4, 222/145, 135, 188, 571; 99/275; 259/4 R, 18, 36; 418/154

[56] References Cited

U.S. PATENT DOCUMENTS

| | | | |
|---|---|---|---|
| 3,568,887 | 3/1971 | Jacobs et al. | 222/70 |
| 3,832,105 | 8/1974 | Takahashi | 418/154 |
| 3,880,329 | 4/1975 | Gardner et al. | 222/129.1 |

*Primary Examiner*—Allen N. Knowles
*Assistant Examiner*—John P. Shannon
*Attorney, Agent, or Firm*—Michael J. Striker

[57] ABSTRACT

A high-viscosity liquid is accommodated in a container whose outlet directly communicates with the intake port of a pump. The intake port communicates via a pump chamber with an outlet port of the pump, and an impeller having flexible blades rotates eccentrically in the chamber so that the blades wipe the surface of the wall bounding the chamber and pump liquid through the outlet port into a mixing chamber through which a water nozzle directs a stream of water which traverses the chamber and becomes mixed with the liquid to issue from an outlet of the mixing chamber as a completed beverage.

12 Claims, 9 Drawing Figures

Fig. 4
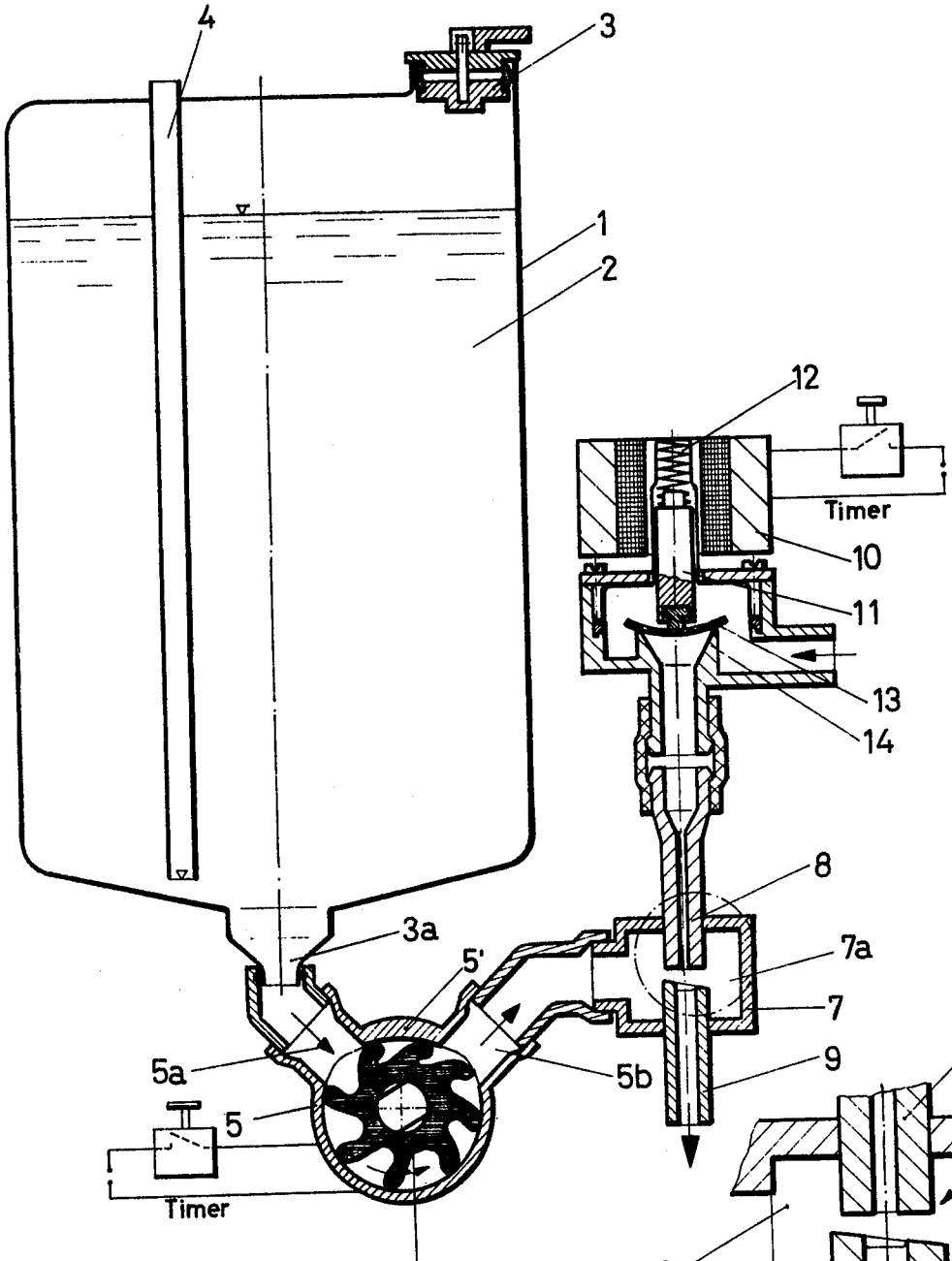
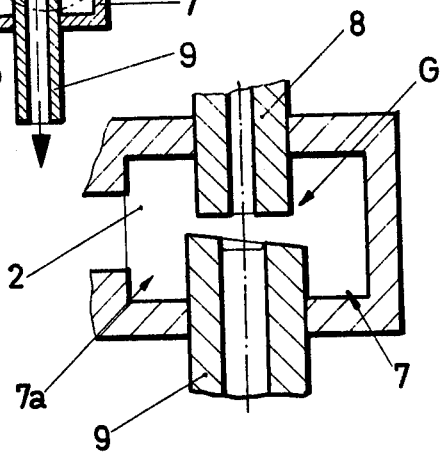
Fig.5

Fig. 6
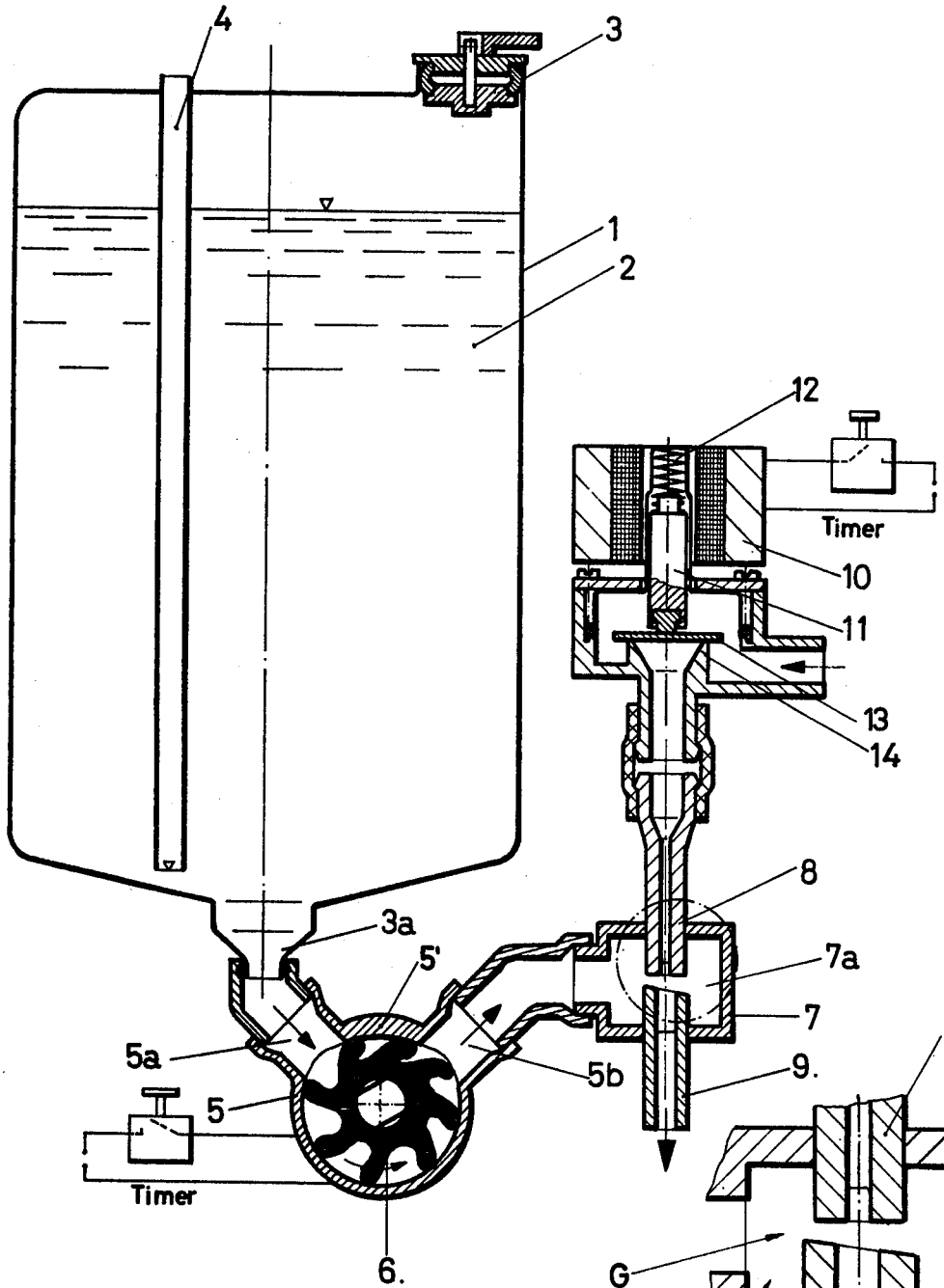
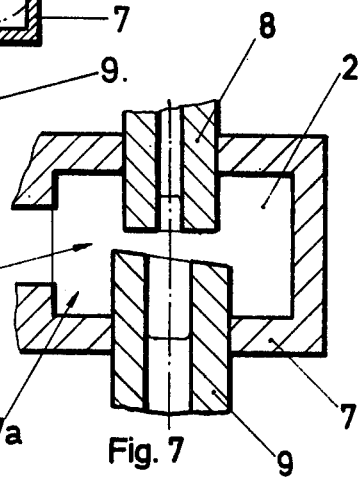
Fig. 7

Fig. 8
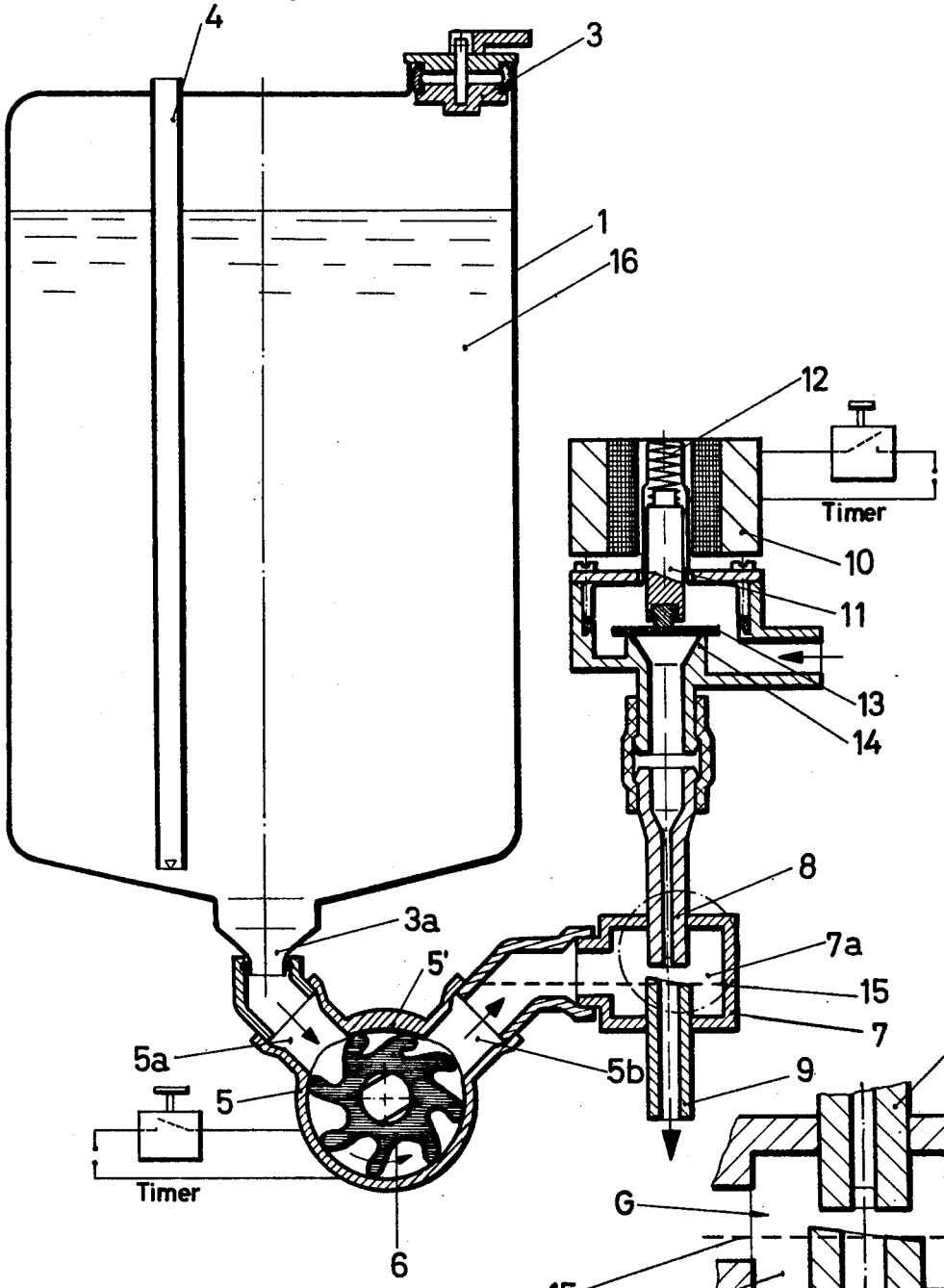
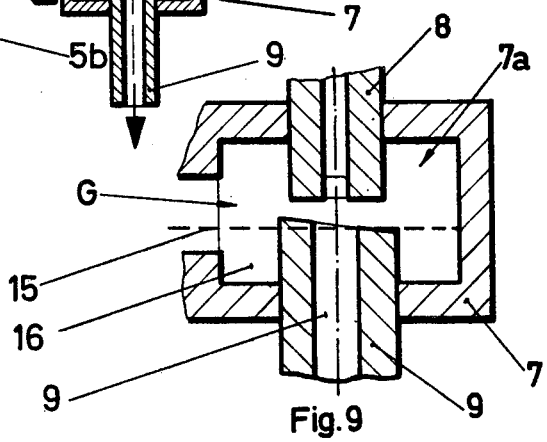
Fig. 9

METHOD OF AND APPARATUS FOR DISPENSING SELF-CONSERVING LIQUIDS

This is a continuation of application Ser. No. 560,798, filed Mar. 21, 1975 and now abandoned, which in turn was a continuation-in-part of application Ser. No. 536,592, filed Dec. 26, 1974 and now abandoned.

BACKGROUND OF THE INVENTION

The present invention relates to a method and an apparatus for dispensing high-viscosity liquids, such as syrups and concentrates.

Syrups and concentrates must be dispensed under various circumstances, for example from dispensing machines. Various problems are encountered in exactly proportioning the amount of syrup or concentrate to be added to liquid in order to obtain a potable beverage. These include hygienic problems because syrups and concentrates, insofar as they are used to produce beverages, such as lemonade with or without carbon dioxide or the like, have the disadvantage in hygienic respect that they are usually composed of organic materials which tend to spoil. For this reason, such concentrates usually have preservatives added to them. It is often undesired to have to add such preservatives, but the only alternative then is to use so much sugar in the syrup or concentrate that Brix values in excess of 60 are obtained, which results in a self-conserving action of the syrup or concentrate.

In all instances, however, that, is irrespective of whether or not preservatives are added, difficulties still remain in the transportation of such syrups and concentrates, the dosing for a particular dispensing operation, and the mixing of the dosed quantity of syrup or concentrate with the water required to produce the finished beverage.

In my prior U.S. Pat. Nos. 3,258,166 and 3,807,607, I have shown two devices for dispensing high-viscosity liquids. These devices constitute significant advances over the state of the art prior to them, but they still require opening and closing of a valve and the equipment to effect such opening and closing, and the problem of eliminating non-hygienic conditions during and after the mixing of the syrup or concentrate with, for example cooled water, is not yet fully solved in my prior-art patents.

If such devices are used to dispense syrups or concentrates of high viscosity and a high Brix number which have a self-conserving action while they are accommodated in a storage vessel, problems are encountered in that after the dispensed quantities have become mixed with liquid such as water or the like to form a beverage, residual amounts of the beverage will remain in the mixing chamber and since due to the mixing the self-conserving action has been eliminated, rapid spoilage then will take place. This means that the prior-art equipment must be frequently, expensively and very carefully cleaned. If such cleaning is not punctiliously carried out, hygienic problems are encountered, particularly as concerns the growth of undesired bacteria.

SUMMARY OF THE INVENTION

The present invention aims to overcome these difficulties.

More particularly, it is an object of this invention to provide an improved method of and apparatus for dispensing high-viscosity liquids, such as syrups and concentrates, which avoids the aforementioned drawbacks.

Still more specifically, the present invention intends to provide a method and an apparatus of the type in question wherein hygienic problems are eliminated.

Another object of the invention is to provide such a method and apparatus in which a special dosing device for metering of the quantities of syrup and concentrate being dispensed, is no longer required, contrary to the prior art.

In keeping with these objects, and with others which will become apparent hereafter, one feature of the invention resides in a dispenser for high-viscosity liquids, such as syrups and concentrates, which briefly stated comprises a container for a body of high-viscosity liquid, this container having an outlet, and a pump housing having an intake port directly communicating with the outlet, a discharge port, and a chamber intermediate the ports. An impeller is mounted in the chamber for rotation about an eccentric axis and has elastically yieldable impeller blades which substantially continuously advance a predetermined quantity of the liquid from the intake port to the discharge port per unit of time.

It is already known in the prior art to employ in beverage dispensers which dispense lemonade and fruit juice, so-called hose or peristaltic pumps. This type of pump has a relatively short lifetime and generally requires that syrups and concentrates are used which have a lower Brix number than 60, i.e., which can be conserved only by adding preservative to them and which cannot rely on self-conservation due to a high sugar content. Moreover, these pumps have the disadvantage that they operate in form of pulses, whereas the water that is supplied to become admixed with the syrup or concentrate runs continuously, so that the finished beverage often will be nonhomogeneous.

The present invention avoids these difficulties by using an impeller pump of the type which is known for feeding purposes where the impeller rotates at high speeds, but which has not been applied heretofore as a metering pump. Pumps are known having an eccentric housing in which the individual feeding chambers are defined between the inner surface bounding the pump chamber and circumferentially consecutive blades of an impeller, which blades are of an elastically yieldable material. Such pumps are usually directly connected to a motor of appropriately high number of revolutions per unit time and are used to feed material in various fields of art at a high rate of flow and at a high pressure.

In the automatic dispensing of beverages, however, volumes are usually metered which amount to between 10 and 40 cc (cubic centimeters). The present invention utilizes an impeller pump in which the normally high number of revolutions of the impeller, which is usually in excess of 500 rpm, is reduced to between substantially 20 and 60 rpm. When this is done, the pump will feed, in dependence upon the revolutions per minute and the time period for which the impeller operates, a precisely predeterminable quantity of high-viscosity liquids, such as syrups and concentrates, per unit time. This quantity remains unchanged even though drinking water may be metered and fed in place of high-viscosity liquid. This means that viscosity fluctuations will now no longer have an adverse influence on the accuracy of the amount of liquid that is being metered per unit time. The amount of solids that may be accommodated in the liquid, for instance fruit pulp, seeds or the like, does not adversely influence the metering accuracy since the elastically yieldable impeller blades wipe over the inner surface bounding the pump chamber and keep it free of encrustations or the like that could have such an influence.

As compared to the use of a known peristaltic pump, the arrangement according to the present invention has the additional substantial advantage that it permits the desired metering in a practically continuous flow, and not in form of flow pulses. Because of this, the mixing of the metered syrup or concentrate with a carrier such as drinking water to produce a homogeneous beverage, is substantially simplified by the present invention because a high water pressure of, for example 1.5 or even 2 atms, is no longer necessary, contrary to the requirements of the prior art. This means that the present invention is usable even in applications where prior-art devices will no longer function properly, either because they require too much water or because the pressure available is too low.

The arrangement according to the present invention may be used, for example, in conjunction with the device disclosed in U.S. Pat. No. 3,806,607, in that the intake port of the impeller pump is directly connected with the syrup or concentrate container disclosed in that patent, without requiring an additional metering valve.

A device constructed according to the present invention was employed under the most adverse conditions for a period of three months, and was constantly subjected to supervision and testing. It was found that over a period of 3 months, the device did not have to be cleaned a single time, and despite this no deterioration of hygienic conditions was observed. The device was employed for dispensing of syrups and concentrates having a Brix number of 65 and 66, that is having a self-conserving characteristic which made it possible to refill the reservoir without first having to remove residual syrup or concentrate from the reservoir, thus permitting the new syrup or concentrate to be mixed with the old syrup or concentrate without adverse results.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 4 shows the apparatus of FIG. 2 in a different operating condition;

FIG. 5 is a sectional detail view of FIG. 4;

FIG. 6 shows the apparatus of FIG. 2 in an operating condition immediately following the one illustrated in FIG. 3;

FIG. 7 is a sectional detail view of FIG. 6;

FIG. 8 shows the apparatus of FIG. 2 in inoperative position; and

FIG. 9 is a sectional detail view of FIG. 8.

DESCRIPTION OF THE PREFERRED EMBODIMENTS

Figure 1:
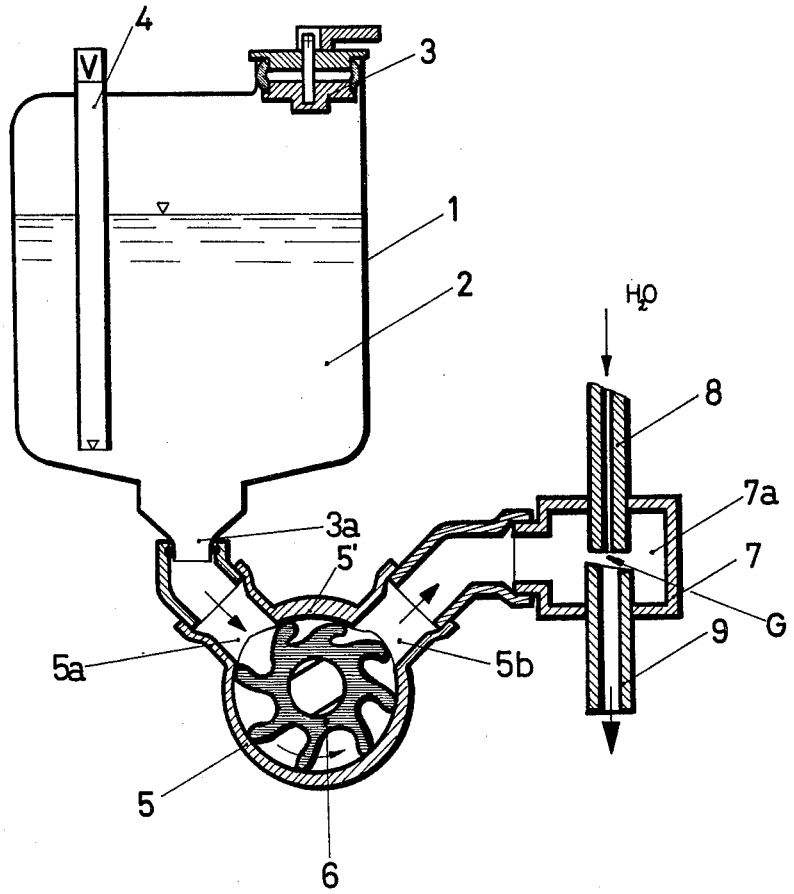
FIG. 1 is a diagrammatic vertical section showing an apparatus according to the present invention, with portions omitted.

The invention will hereafter be described with respect to a single exemplary embodiment of the apparatus, and the description of the apparatus will also serve as an explanation of how the method according to the invention is carried out.

In FIGS. 1–9, reference numeral 1 identifies a reservoir or container for syrup or concentrate, that is a high-viscosity liquid to be dispensed. The principle of the invention will first be described with reference to FIG. 1. Reference numeral 2 identifies the body of such liquid in the reservoir 1. Reference numeral 3 identifies an air-tightly sealed inlet through which additional liquid 2 may be added when the inlet is temporarily opened. Reference numeral 3*a* identifies an outlet in a bottom wall of the reservoir 1, and reference numeral 4 identifies a vent tube which changes the static pressure head in the vicinity of the bottom wall of the reservoir 1, independently of the amount of liquid 2 contained in the reservoir 1, in the manner described in U.S. Pat. No. 3,258,166. The bottom end of tube 4 is open; its upper end is provided with a diagrammatically shown valve V whose construction and operation correspond to those of valves 12 and 40 in U.S. Pat. No. 3,807,607.

Reference numeral 5 identifies an eccentric pump housing having a pump chamber with which an intake port 5*a* and a discharge port 5*b* communicate. An impeller 6 is mounted for rotation in the pump housing; its shaft is driven by a motor M (shown diagrammatically and only in FIG. 2) and the impeller has elastically yieldable impeller blades which engage the inner circumferential wall bounding the pump housing and wipe over it. Since the housing 5 is eccentric (note the greater wall thickness at the upper wall 5' of the housing), the blades 6 will become deflected as they travel along the upper wall 5'; thus, the fluid space defined between any two successive blades 6 will be volumetrically reduced when the leading blade of the pair undergoes such deflection, thereby squeezing the syrup or concentrate out of the space and into the discharge port 5*b* before the trailing blade of the pair engages the upper wall 5'. As the vanes of the pair subsequently move out of engagement with wall 5', the space between them increases again, creating a suction effect at the intake port 5*a*. Reference numeral 7 identifies a housing which forms a mixing chamber 7*a* that communicates with the discharge port 5*b* of the pump. A water supply conduit 8 communicates with the mixing chamber 7*a*, and located opposite it is an outlet conduit or beverage dispensing conduit 9 which also communicates with the chamber 7*a*.

The mixing chamber 7*a* is constantly filled with liquid 2 even though the pump may not be in operation. The cross-sectional areas of the water inlet conduit 8 and the beverage dispensing conduit 9 are different, as illustrated, and in particular the conduit 8 has a smaller cross-sectional area than the conduit 9 and is so constructed that when the dispensing operation begins, a stream of water issuing from the conduit 8 traverses the chamber 7*a* and enters the conduit 9.

The upper end of dispensing conduit 9 is cut off at an angle, as shown, and forms with the lower end of conduit 8 the gap G through which concentrate enters the conduit 9. The angled cut-off and the gap G have been chosen to prevent the concentrate entering from the pump from flowing too freely to the inlet of conduit 9 and thereby disturbing the mixing of water and concentrate which takes place in the region between the outlet end of conduit 8 and the inlet end of conduit 9.

This mixing takes place because, in accordance with the injector principle and also as a result of the feeding of liquid 2 by the pump 5 which begins when the dispensing operation is initiated, liquid 2 (i.e., concentrate or syrup) is taken along in the mixing chamber *7a* by the stream of water which travels from the conduit 8 into the conduit 9, becoming admixed with the water and leaving the conduit 9 as a finished beverage. The desired Brix number in the finished beverage, that is in the mixture of water and liquid 2, depends upon the cross-sectional area of the conduit 8 with respect to the cross-sectional area of the conduit 9, and upon the feeding capacity of the pump per unit time in dependence upon the number of revolutions that has been set.

As a result of a residual feeding effect of the pump, which may continue to feed for a brief period of time after the admission of water via conduit 8 has terminated, additional liquid 2 is admitted into the mixing chamber *7a* and forms a "plug" which more or less fills the outlet conduit 9, depending upon the time period for which the pump continues to operate after the dispensing is completed, and the presence of this "plug" and the self-conserving action of the liquid 2 prevent the occurrence of hygienic problems in this area of the apparatus.

The admission of additional liquid 2 after the dispensing operation is completed can also be volumetrically determined in that the level of liquid 2 in the mixing chamber 7 is allowed to drop to the upper level of the outlet 9, so that there is no direct contact between the water in the conduit 8 and the contents of the outlet 9. The liquid 2 is so thick that a column of it is retained in the outlet passage 9 without flowing out of the same, even if the outlet 9 is not controlled by a valve, since underpressure will develop in the chamber *7a* when the pump stops feeding.

Figures 2, 3:
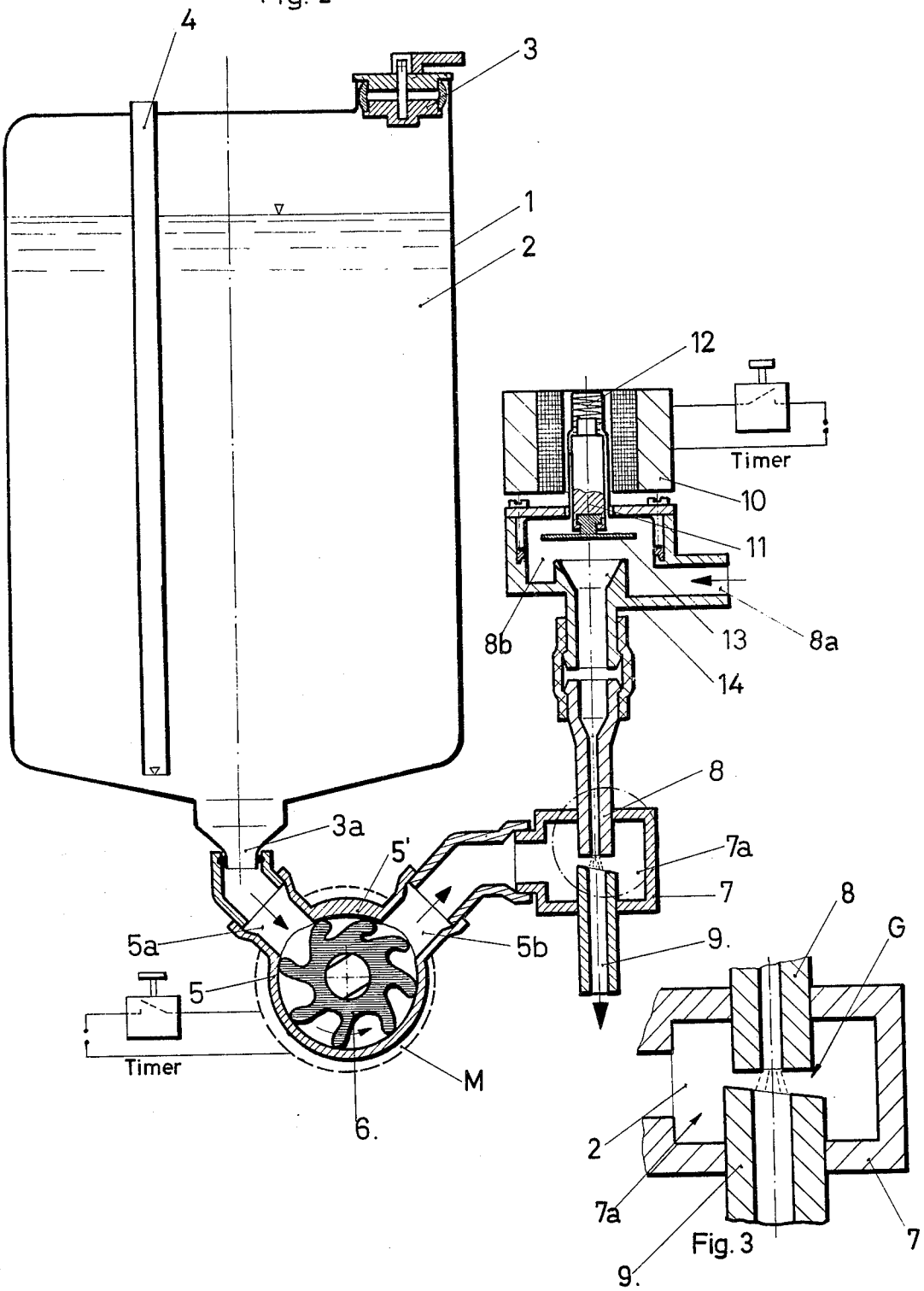
FIG. 2 is a view similar to FIG. 1, but further illustrating the associated controls and showing the apparatus in one operating condition thereof.
FIG. 3 is a sectional detail view of FIG. 2.

FIGS. 2–4 show different operating states of the apparatus in FIG. 1; they also include illustrations of control equipment which were omitted in FIG. 1.

In FIG. 2 the apparatus is shown in a condition in which the pump 5 operates and the liquid 2 has entered the mixing chamber *7a*. A timer-controlled electromagnetic valve 10 has been opened at this time, to permit the flow of water through the passage *8a* into the conduit 8. A jet or stream of water now flows at constant pressure across the gap G and into the conduit 9 (see FIG. 3). In so doing the water jet produces an injector-like suction effect which, combined with the pressure exerted by pump 5 upon the liquid 2 in chamber *7a*, serves to effect mixing of liquid 2 with the water jet during entry of both fluids into the conduit 9. The water enters conduit 8 at a pressure of approximately 1 atmosphere. It can do so because at this time the energization of valve 10 has caused a plunger 11 to be retracted upwardly, thus moving a flexible sealing member 13 of rubber or synthetic plastic material in the chamber *8b* out of engagement with the conical inlet 14 of the conduit 8. The plunger 11 is permanently biased by a spring 12 to return to its rest position in which sealing member 13 seals the inlet 14.

FIGS. 4–7 show the apparatus of FIG. 2 during the terminal phase of its operation. The timer for the valve 10 has de-energized the same, so that sealing member 13 is urged into sealing engagement with inlet 14 by the spring 12. In consequence, the water jet across gap G has ceased to exist (compare FIG. 5). Initially, the spring 12 flexes the sealing member 13 into inlet 14, as shown in FIG. 4; however, the elasticity of sealing member 13 assures that the member 13 will return to planar condition as shown in FIG. 6. The amount of flexure is small; it is sufficient, however, to draw the remaining water column in conduit 8 upwardly due to suction, by about 1–2 mm. (see FIG. 7). Since the pump 5, whose motor M is also controlled by a timer, operates just slightly longer than the valve 10 is open, some additional liquid 2 enters the chamber *7a* and the conduit 9, forming at the upper end of the latter a "plug" (see FIG. 5) of unmixed liquid 2, i.e., of syrup or concentrate. The water column in conduit 8 is out of engagement with the liquid 2 in chamber *7a*, due to its upward retraction. The "plug" in conduit 9 remains in place, because it is too viscous to flow out by itself. Since it also has self-conserving anti-bacterial properties, as outlined earlier, it prevents contamination of the arrangement.

The upward withdrawal of the water column in conduit 8 could also be achieved in a different manner. For example, the lower end of plunger 11, or the conduit 8 at its inlet 14, could themselves be of elastically yieldable material which would act in the same manner as the element 13 and thus perform the water column raising function. Also, the water might be forced from passage *8a* through a resilient tube or the like, which could be supported by a rigid pipe so that it cannot yield outwardly while water flows into the conduit 9. During closing the valve 10, however, the inertia of the mass involved would result in a slight constriction of the tube, and upon completion of the valve closing operation the spring-back effect would restore the tube to its original shape, causing the desired retraction of the water column in direction towards the valve 10.

FIGS. 8 and 9, finally, show the apparatus in its rest or inoperative position. The valve 10 is closed, the pump 5 de-energized. The liquid 2 no longer completely fills the chamber *7a* at this time.

It is well known that the viscosity of different syrups and concentrates may vary, despite the fact that the materials all have the same Brix value. FIGS. 8 and 9 show the circumstances which will obtain if the liquid 2 has a Brix value sufficiently high (i.e., 60 or higher) to make it self-conserving, but has a relatively low viscosity. Under these conditions the pump 5 will be shut off together with the closing of valve 10, rather than being allowed a slight lag time as in the basic operation described with respect to the preceding Figures. The concentrate or syrup is designated with reference numeral 16 to distinguish it from the higher-viscosity concentrate or syrup 2. It has dropped in chamber *7a* to the level 15 at which it no longer is above the inlet of conduit 9. Nevertheless, since in this case as in the preceding Figures the water column is retracted from contract with the concentrate or syrup 16, and since the concentrate or syrup has a Brix value which makes it self-conserving, spoilage of the liquid 16 due to the growth of bacteria or for other reasons is still reliably avoided, despite the fact that the viscosity of liquid 16 is low enough so that the contents of conduit 9 can run out and do not form a "plug" therein due to inadequate surface tension of the liquid 16.

Bacteriological examinations have shown that in the test apparatus no bacteria or fungi could be found after an operating period of 3 months, which was interrupted for weekend and holiday periods as would be the case in actual use.

The impeller pump used in the apparatus according to the present invention will always produce identical pressure conditions at the suction side. The pressure at the discharge side is slightly increased, but not so high as the pressure, for example at the water side, that is where water is admitted into the mixing chamber 7. The latter is relatively small and, as pointed out, is constantly filled with the liquid 2 under operating conditions. The water is admitted at a pressure of approximately 1 atm, and in any case at a pressure that is higher than the pump pressure at the discharge port of the pump.

Because of this, when the pump impeller is caused to rotate and water is discharged from the conduit 8, the water can be directed in a stream into the larger cross section outlet conduit 9, taking along predetermined amounts of liquid 2 in accordance with the injector principle and which may be varied in dependence upon the pump pressure of the pump, and during this action the water becomes homogeneously mixed with the liquid 2 that it has taken along to form therewith a homogeneous beverage.

It will be understood that each of the elements described above, or two or more together, may also find a useful application in other types of constructions differing from the type described above.

While the invention has been illustrated and described as embodied in the dispending of high-viscosity liquids, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A dispenser for liquids, comprising a container for a body of a high-viscosity first liquid; wall means defining a mixing chamber; a supply conduit for a less viscous second liquid to be admixed with the first liquid so as to form a product liquid, said supply conduit having a supply opening and being in permanent communication with said mixing chamber; a capillary dispensing conduit for product liquid in permanent communication with said mixing chamber and having an inlet and a permanently open outlet, said capillary dispensing conduit permitting free flow therethrough of said second liquid and said product liquid but not of the high-viscosity first liquid; pump means communicating with said container and with said mixing chamber to supply the latter with the first liquid which becomes mixed with the second liquid from said supply conduit and is immediately dispensed through said dispensing conduit as product liquid; means for interrupting the supply of the second liquid to said mixing chamber before the first liquid advanced by said pump means ceases to enter said mixing chamber so that an excess quantity of the high-viscosity first liquid enters said dispensing conduit; and means for preventing dilution of the excess quantity of the first liquid by contact with the second liquid in said supply conduit so that the excess quantity of the first liquid retains its high viscosity and forms a seal in said dispensing conduit due to the capillarity of said dispensing conduit.

2. A dispenser as defined in claim 1, wherein said pump means includes a pump housing having an intake port directly communicating with said container, a discharge port communicating with said mixing chamber, a pump chamber intermediate said ports, an impeller mounted in said pump chamber for rotation about an eccentric axis and having elastically yieldable impeller blades which substantially continuously advance a predetermined quantity of said liquid from said intake port to said discharge port per unit time, and a motor for rotating said impeller.

3. A dispenser as defined in claim 2, wherein said conduits have different cross-sectional areas and the mixing ratio of the liquids is a function of the difference in said cross-sectional areas and of the revolutions performed by said impeller per unit time.

4. A dispenser as defined in claim 3, wherein the cross-sectional area of said dispensing conduit is greater than that of said supply conduit.

5. A dispenser as defined in claim 2, wherein said impeller blades wipingly engage an inner circumferential surface of said pump chamber during the rotation of said impeller.

6. A dispenser as defined in claim 2, wherein said impeller rotates at fewer than 100 revolutions per minute.

7. A dispenser as defined in claim 2; further comprising timer means for timing the operation of said impeller.

8. A dispenser as defined in claim 2, comprising a valve controlling the flow through said supply conduit, said interrupting means comprising a first timer controlling the valve-open period of said valve; and a second timer controlling the operating time of said motor.

9. A dispenser as defined in claim 1, wherein said dispensing conduit has an end portion in said mixing chamber, said end portion being cut off at an angle to the axis of said dispensing conduit and said inlet and supply openings forming between themselves a gap.

10. A method of dispensing liquids, comprising admitting a high-viscosity first liquid into a mixing chamber; directing a less viscous second liquid into said mixing chamber via a supply opening therefor; mixing said first and second liquids in said mixing chamber to form a product liquid; withdrawing said product liquid from said mixing chamber via an outlet opening therefor; terminating said directing; continuing said admitting for such a period subsequent to termination of said directing that said outlet opening becomes sealed by a quantity of said first liquid; and thereafter terminating said admitting.

11. A method as defined in claim 10, wherein said first liquid is admitted into said mixing chamber at a substantially uniform rate of flow per unit of time.

12. A dispenser for liquids, comprising a container for a body of a high-viscosity first liquid; wall means defining a mixing chamber; a supply conduit for a less viscous second liquid to be admixed with the first liquid so as to form a product liquid, said supply conduit having a supply opening and being in permanent communication with said mixing chamber; a product liquid dispensing conduit in permanent communication with said mixing chamber and having an inlet and a permanently open outlet; pump means communicating with said container and with said mixing chamber to supply the latter with the first liquid which becomes mixed with the second liquid from said supply conduit and is immediately dispensed through said dispensing conduit as product liquid; means including a valve in said supply conduit for interrupting the supply of the second liquid to said mixing chamber before the first liquid advanced by said pump means ceases to enter said mixing chamber so that an excess quantity of the first liquid enters said dispensing conduit and a column of said second liquid remains in said supply conduit upon interruption of the flow of said second liquid through said supply conduit; means for retracting said column of said second liquid inwardly away from said supply opening of said supply conduit; and means for preventing dilution of the excess quantity of the first liquid by contact with the second liquid in said supply conduit so that the excess quantity of the first liquid may retain its high viscosity and form a seal in said dispensing conduit.

* * * * *